United States Patent [19]

Prada et al.

[11] Patent Number: 4,890,873

[45] Date of Patent: Jan. 2, 1990

[54] HAND-HELD CARRIER FOR A ROLL OF BLUEPRINTS AND CUT BLANK THEREFOR

[76] Inventors: Camilo Prada, 2222 NE. 37th St., Lighthouse Point, Fla. 33064; Jack R. Paoli, 4900 N. Ocean Blvd. #511, Ft. Lauderdale, Fla. 33308

[21] Appl. No.: 184,611

[22] Filed: Apr. 21, 1988

[51] Int. Cl.[4] ..... B65D 71/02

[52] U.S. Cl. ..... 294/152; 294/138

[58] Field of Search ..... 294/31.2, 74, 87.2, 294/87.28, 137, 138, 141, 142, 146, 149, 151–157, 159, 167, 169, 172, 164, 165; 150/52 R, 52 B; 190/107; 229/52 A, 52 B, 93; 220/441

[56] References Cited

U.S. PATENT DOCUMENTS

| | | | |
|---|---|---|---|
| 399,979 | 3/1889 | Dyrenforth | 294/138 |
| 473,540 | 4/1892 | Wheeler | 294/138 |
| 1,140,540 | 5/1915 | Smith | 294/159 |
| 1,373,136 | 3/1921 | Kranz | 294/138 |
| 1,448,866 | 3/1923 | Redoute | 294/159 |
| 2,397,898 | 4/1946 | Wesselman | 294/167 X |
| 2,513,762 | 7/1950 | Tyson | 294/159 |
| 2,548,252 | 4/1951 | Bergstein | 229/52 A |
| 3,373,917 | 3/1968 | Cox | 229/52 A X |
| 4,478,452 | 10/1984 | Clemens | 294/149 X |
| 4,729,505 | 3/1988 | Remaks et al. | 220/441 X |

FOREIGN PATENT DOCUMENTS

| | | | |
|---|---|---|---|
| 187795 | 11/1922 | United Kingdom | 190/107 |
| 869651 | 6/1961 | United Kingdom | 294/152 |
| 960634 | 6/1964 | United Kingdom | 294/149 |
| 2163949 | 3/1986 | United Kingdom | 294/159 |

*Primary Examiner*—Johnny D. Cherry
*Attorney, Agent, or Firm*—LeRoy Greenspan

[57] ABSTRACT

A carrier comprising a single cut blank of stiff sheet material, such as cardboard, plastic or corrugated paper-board including a substantially rectangular center section and a pair of side or lateral sections. The center section has parallel fold lines or scores impressed along and between the long sides thereof whereby the center section can be incrementally bent to a semicircle and the distal edges of the lateral sections can be brought together. There are handle holes closely spaced from the distal edges of the lateral sections. The center section has end portions, which extend beyond the lateral sections, around which a band or strap or other binder can be located. This includes both the cut blank and the novel carrier made from it.

20 Claims, 3 Drawing Sheets

FIG.6
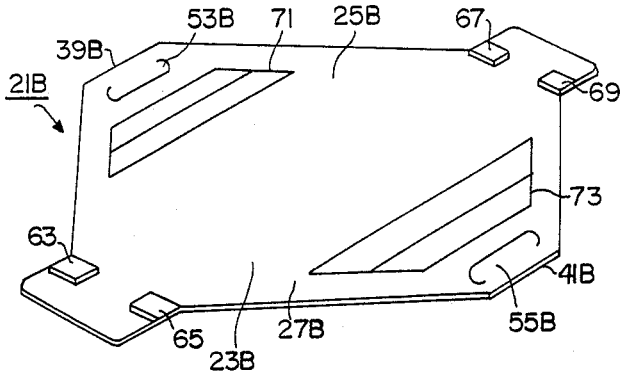
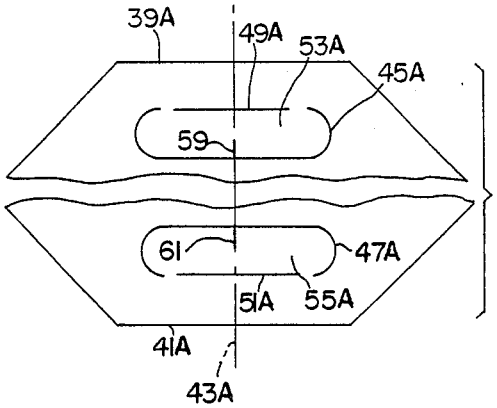
FIG.5
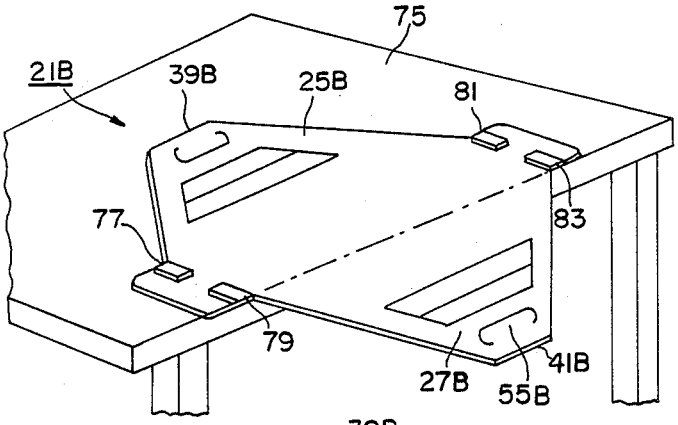
FIG.7
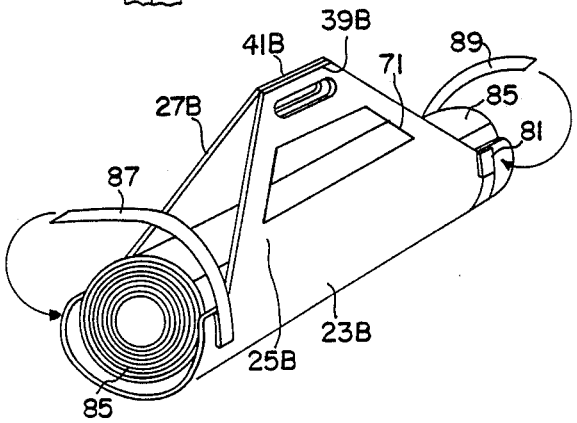
FIG.8
FIG.9
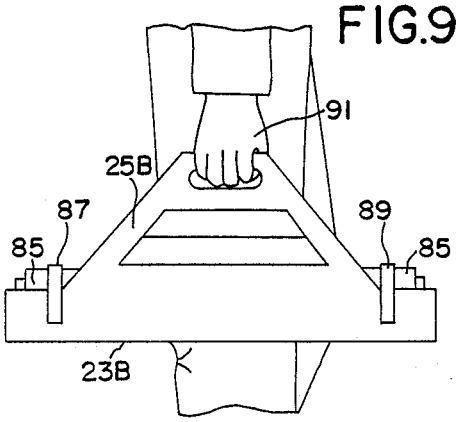

HAND-HELD CARRIER FOR A ROLL OF BLUEPRINTS AND CUT BLANK THEREFOR

BACKGROUND OF THE INVENTION

This invention relates to a novel carrier for a roll of blueprints or the like, and to a novel cut blank for producing the novel carrier.

Various types of slings and hand-held carriers with open ends have been described previously; for examples, see U.S. Pat. Nos. 3,481,519 to W. Snetselaar; 3,792,806 to L. Layton; 3,804,311 to R. K. Oglesbee; 4,316,629 to G. C. Jacoby; and 4,055,287 to C. E. Champenois, Jr. These manual carriers are each designed and adapted for special purposes and not particularly for carrying a roll of blueprints or the like.

Details of buildings, machines, and other structures are presented frequently on a multiplicity of large, generally heavy-weight sheets, which may be original drawings and compilations of information, or may be copies thereof. All of these possibilities are included in the term "blueprints" as used herein. These blueprints are transported from office to office manually, with an elastic band around them, or in a make-shift sling, or in a tube, or in a tubular container. Where no carrier is used, the sheets get dirty and dog-earred. Prior carriers are awkward and relatively expensive to use. Also, rolls of blueprints are heavy, and in makeshift slings may be damaged, or the roll may slip out of the sling, due to the weight of the roll.

OBJECTS OF THE INVENTION

An object of this invention is to provide a novel carrier for a roll of blueprints or the like that is relatively inexpensive and may even be considered disposable.

A further object is to provide a novel carrier for a roll of blueprints or the like which protects the sheets of the roll from dirt and damage, is light in weight, and convenient to use.

Still another object is to provide a novel carrier for a roll of blueprints or the like which can be made in a variety of sizes to accommodate rolls of different diameters, different weights and different lengths.

Yet another object is to provide a novel hand-held carrier for a roll of blueprints or the like wherein the roll cannot fall out of the carrier.

SUMMARY OF THE INVENTION

The foregoing and other objects are realized with the novel carrier which is made from a single cut blank of stiff sheet material, such as cardboard, or plastic sheet, or corrugated paperboard. The single blank comprises a substantially rectangular center section having substantially parallel long sides, and a pair of lateral sections having proximal edges integral with and attached to the long sides of the center section.

The center section has a plurality of substantially parallel fold lines or scores across its width along and between the long sides. The center section is bent incrementally along the fold lines to a semicircular shape that is adapted to carry the roll of papers, and so that the distal edges of the lateral sections are brought together. Closely spaced from the distal edges are handle means, preferably in the form of handle holes having attached handle flaps, which may overlap, or interleave. The length of the center section is such that the end portions thereof extend beyond each lateral section, and also is designed to be longer than the roll to be carried therein.

In use, the roll is merely placed inside the semi-circular center section, the distal edges of the lateral sections are brought together, and the combination manually carried using the handle means. To assure that the roll does not slip out of the carrier, a binding means, such as a rubber band or a strap, may be placed around the roll and the extended end portion. The binding means may include a pair of VELCRO fasteners, with one of the fastener pair adhered to the exterior surface of the center section.

The center section has major outer and inner surfaces and substantially parallel fold lines or scores along and between the long sides thereof. The lateral sections have proximal edges and opposite distal edges, wherein the proximal edges are shorter than and symmetrically attached to the long sides of the center section. Closely spaced from the distal edges of the lateral sections are handle means, preferably handle holes elongated in the direction parallel to the long sides and handle flaps attached to the handle holes on the sides thereof closest to the distal edges.

The novel carrier can be inexpensively fabricated, shipped, and distributed in the form of the novel cut blank. The user can easily assemble the novel carrier in any of its forms. The novel carrier is light in weight, convenient to use and protects the carried roll from dirt and damage. The novel carrier can be made in a variety of sizes to accommodate rolls of different diameters, lengths and weights. Yet, because of its structure and low cost, the carrier can be considered disposable.

BRIEF DESCRIPTION OF THE DRAWINGS

FIG. 5 is a broken-away view of a second cut blank for producing a second embodiment of the novel carrier with a modified handle means.

FIG. 6 is a perspective view of a third cut blank for producing a third, preferred embodiment of the novel hand-held carrier.

FIGS. 7, 8 and 9 are perspective views of the third embodiment shown in FIG. 6, showing steps to be carried out by the user for assembling and using the carrier.

DETAILED DESCRIPTION OF THE INVENTION INCLUDING THE PREFERRED EMBODIMENT

Figure 1:
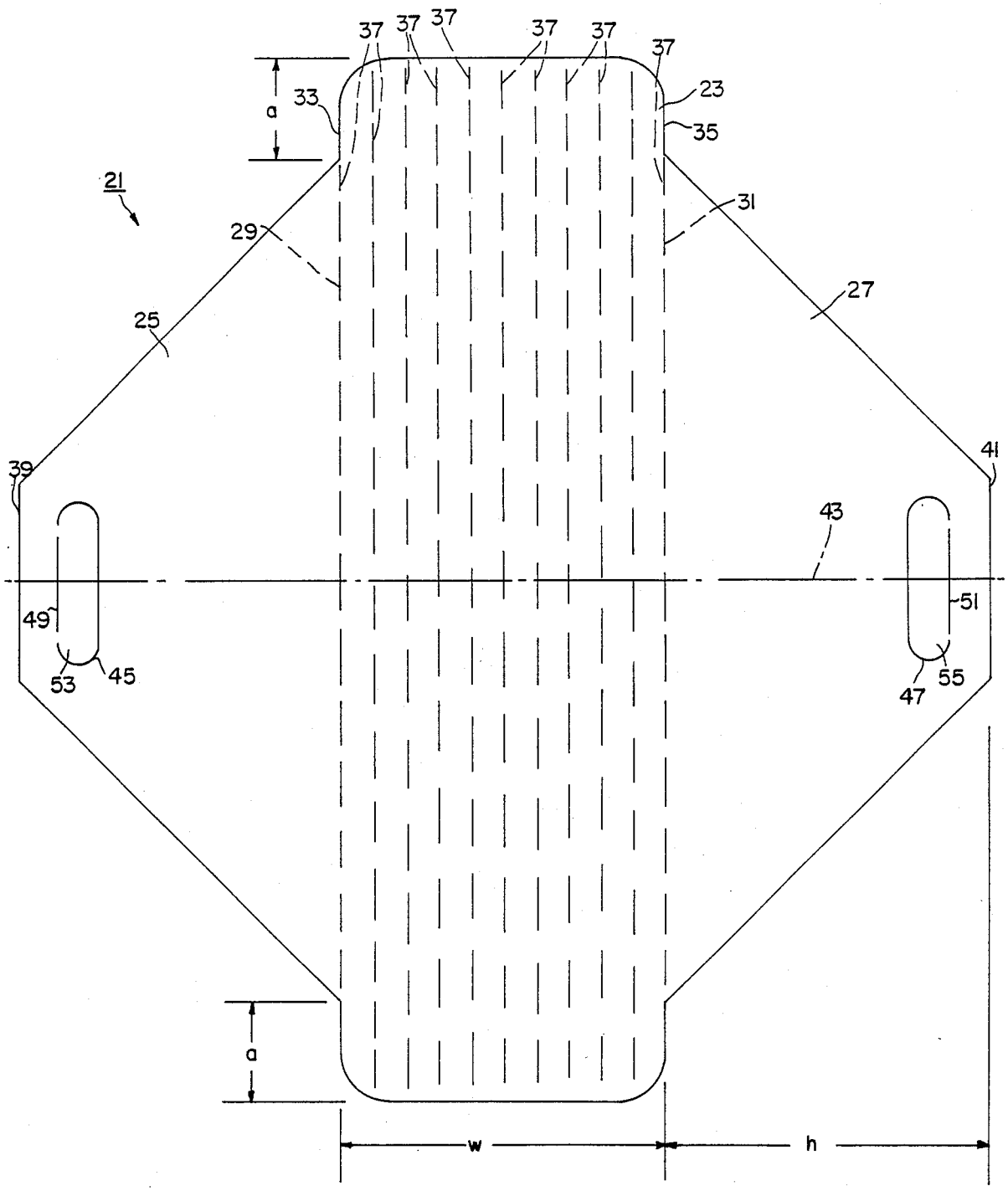
FIG. 1 is a plan view of the inside surface of a first cut blank for producing a first embodiment of the novel hand-held carrier.

The following description of some of the preferred embodiments of the concepts of this invention is made in reference to the accompanying figures. Where an individual structural element is depicted in more than one figure, it is assigned a common reference numeral for simplification of identification and understanding.

FIG. 1 shows the inside major surface of a cut blank 21 of corrugated paperboard. The cut blank 21 includes a substantially rectangular center section 23 and a pair of side or lateral sections 25 and 27 having their proximal edges 29 and 31 respectively integral with the long sides 33 and 35 respectively of the center section 32. The center section 23 has a plurality (eleven, in this embodiment) of substantially parallel fold lines or scores 37 pressed into the inner surface thereof (but not the outer surface thereof) along and between the long sides 33 and 35. The lateral sections 25 and 27 each have distal edges 39 and 41, respectively; and are each in the shape of a truncated isosceles triangle, the proximal edges 29 and 31 being the bases of the triangles and the distal edges 39 and 41 respectively, being truncated vertices. The center section 23 and the lateral sections 25 and 27 are symmetrical about an axis 43.

Each of the lateral sections 25 and 27 has a handle hole 45 and 47, respectively, cut therein that is centered on the axis 43. Each hole is elongated in a direction normal to the axis 43. The cut for each handle hole includes a straight side portion across the axis 43 and a semi-circular portion at each end. The other side portion on each handle hole is uncut, but has a fold line or score 49 and 41, respectively, thereby defining handle flaps 53 and 55 attached to the side of the hand hole 45 and 47 closest to the distal edge of the lateral section 25 and 27.

The center section 23 has rounded corners, an overall length "l", and width "w". The width "w" is slightly more than half the circumference of the roll that it is designed to carry. The center section 23 extends in length beyond the lateral sections 25 and 27 a distance "a" at both ends of the carrier. There is a distance "h" between the proximal edge 29 and 31 and the distal edge 39 and 41 of each lateral section 25 and 27. Except for the handle holes 45 and 47 and the handle flaps 53 and 55, the dimensions "a", "h", "l" and "w" are provided for a particular roll size and weight.

Shown in FIG. 1 is a specific embodiment for a roll about 15 centimeters (6 inches) in diameter and about 76.2 centimeters (30 inches) long, wherein "a" equals about 7.5 centimeters (3 inches, "h" equals about 25.4 centimeters (10 inches), "l" equals about 81.3 centimeters (32 inches), and "w" equals about 25.4 centimeters (10 inches). The hand holes are elongated to about 12.7 centimeters (5 inches) with a 1.6 centimeter (5/8" inch) radius at each end. The cut blank is made of 250 pound test corrugated paperboard with the corrugations running in the direction of the axis 43 and normal to the fold lines 37. The fold lines are about 45.1 centimeters (2 inches) apart.

Figure 3:
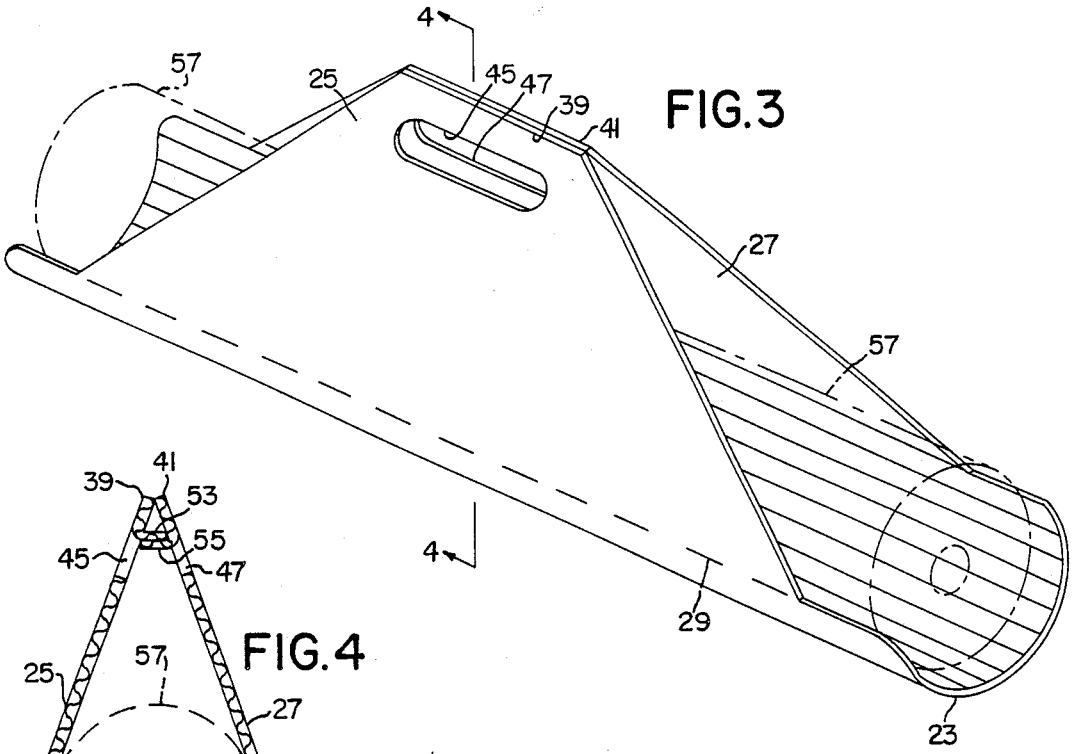
FIGS. 2 and 3 are side and perspective views of the novel carrier produced from the cut blank shown in FIG. 1.
Figure 4:
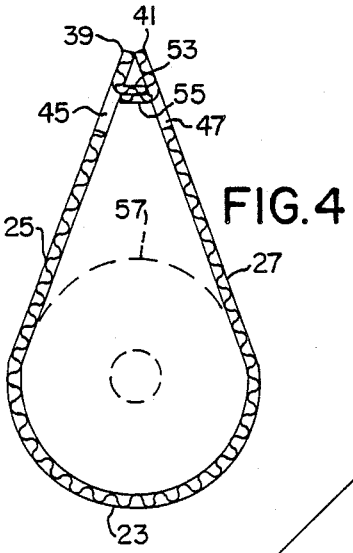
FIG. 4 is a sectional elevation of the carrier shown in FIG. 3 viewed along section line 4—4.
Figure 2:
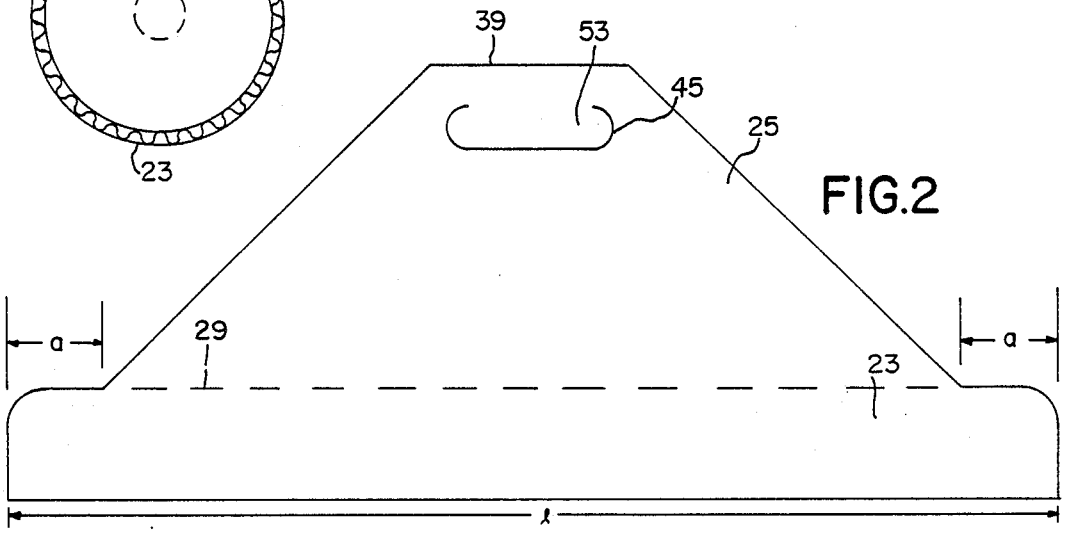

Referring now to FIGS. 2, 3 and 4, the center section 23 is bent along the fold lines 37 to the shape of a cylindrical semicircle (FIG. 2). The handle flaps 53 and 55 are pushed inward and the distal ends 39 and 41 are brought together so the flaps 53 and 55 overlap (FIGS. 3 and 4), thereby forming a carrying handle. The phantom lines 57 show the position that can be assumed by a 6-inch diameter by 30-inch-long cylindrical roll in the center section 23.

FIG. 5 shows the handle holes 45A and 47A of a second embodiment similar to the cut blank 21 shown in FIG. 1, except that each handle flap 53A and 55A has a slot 59 and 61, respectively cut, along the axis 43A, and extending half-way across each flap towards the attached side. When forming the handle, instead of overlapping the handle flaps as shown in FIG. 4, the handle flaps 53A and 55A are interlocked at the slots 59 and 61.

Referring to FIGS. 2, 3 and 4, it may be desirable to take an additional precaution to prevent a roll (as indicated by the phantom lines 57) from slipping out of the carrier. A simple elastic band (not shown) may be placed around the extended end portions (in the dimension "a") of the formed center portion 23 and the roll. Alternatively, a buckled strap or a tied string may be used. The preferred structure is loop-and-pile fastener pairs (VELCRO) at each end of the center section. One preferred structure of this type is included in the third embodiment described below.

The novel carrier may be made in a variety of sizes and shapes to accommodate a variety of usages. It must be realized that papers are available in different weights and, also, different users of the carrier will roll up papers in different tightnesses. Tables I and II present preferred combinations of dimensions for average usages of rolls of 24 inch by 36 inch sheets and 30 inch by 36 inch sheets, respectively. The sheets are rolled starting and ending on their short sides, and are assumed to weigh about 40 grams and 60 grams each, respectively.

The third embodiment shown in FIG. 6 is made from a third cut blank 21 B that is the same as the first cut blank shown in FIG. 1, except that the outside surface thereof has four areas 63, 65, 67 and 69 graphically outlined for the attachment of one of a pair of loop-and-pile fasteners, and also fifth and sixth areas 71 and 73 graphically outlined for advertising or for the entry of data such as a name and address of a user. There are fold lines on the opposite inside surface as in the first cut blank.

The third cut blank 21B is placed on a flat surface 75, such as a table top, as shown in FIG. 7, and one of a pair of loop-and-pile fasteners 77, 79, 81 and 83 is adhesively attached to the outer surface of the center section 23B in the designated areas 63, 65, 67 and 69, respectively. In this example, the pile or soft portion has an adhesive backing and is simply pressed into place. Loop-and-pile fastener pairs are commercially available under the tradename VELCRO.

Then, the cut blank 21B is positioned so that each fold line in turn is at the edge of the flat surface 75 and the center section 23B is bent at the fold line. Thereby, the center section 23B is formed into a semi-circle and the distal edges 39B and 41B are brought together. The handle flaps 53B and 55B are pushed inward so that they overlap as shown in FIG. 4, thereby forming a carrying handle. Next, the distal edges 39B and 41B are separated, a roll 85 of blueprints is placed on the inside of the center section, and the distal edges 39B and 41B are again brought together. Then, as shown in FIG. 8, strips 87 and 89 of the other of the loop-and-pile fasteners pairs are placed across the adhered fastener pairs 77 and 79 and the space therebetween, and adhered fastener pairs 81 and 83 and the space therebetween, respectively. In this example, the strips 87 and 89 are the loop or hard portion of the fastener pairs. FIG. 9 shows the assembled carrier 21B with the roll 85 therein, strapped down with the strips 87 and 89 manually held by the hand 91 of a user.

TABLE I

| Preferred Carrier Dimensions For Rolls of 23" × 36" Paper | | | | | |
|---|---|---|---|---|---|
| sheets per roll | 50 | 100 | 150 | 200 | 250 |
| weight - lbs | 0.90 | 1.80 | 2.70 | 3.60 | 4.50 |
| diameter - inches | 4 | 6 | 8 | 10 | 12 |
| w - inches | 7 | 10 | 13 | 16 | 19 |
| l - inches | 26 | 26 | 26 | 26 | 26 |
| a - inches | 3 | 3 | 3 | 3 | 3 |
| h - inches | 7 | 10 | 13 | 16 | 19 |

TABLE II

| Preferred Carrier Dimensions For Rolls Of 30" × 42" Paper | | | | | |
|---|---|---|---|---|---|
| sheets per roll | 50 | 100 | 150 | 200 | 250 |

TABLE II-continued

| Preferred Carrier Dimensions For Rolls Of 30" × 42" Paper | | | | | |
|---|---|---|---|---|---|
| weight - lbs | 1.35 | 2.70 | 4.05 | 5.40 | 6.75 |
| diameter - inches | 4 | 6 | 8 | 10 | 12 |
| w - inches | 7 | 10 | 13 | 16 | 19 |
| l - inches | 32 | 32 | 32 | 32 | 32 |
| a - inches | 3 | 3 | 3 | 3 | 3 |
| h - inches | 7 | 10 | 13 | 16 | 19 |

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

We claim:

1. A carrier for a roll of blueprints or the like, said roll having a roll length and a roll circumference, said carrier comprising a single piece of stiff sheet material including:

a rectangular center section having substantially parallel long sides, a width therebetween and a length parallel to said long sides, said center section having a plurality of substantially parallel fold lines along and between said long sides, whereby said center section is bent to a semicircular shape substantially conforming to said roll circumference, and a pair of lateral sections integral with said center section, said lateral sections having distal edges and proximal edges, said proximal edges being shorter than and centered on said long sides, each lateral section having a handle means closely spaced from said distal edge of each lateral section.

2. The carrier defined in claim 1 wherein said handle means includes an elongated handle hole and a handle flap centered in and spaced closely from the distal edge of each of said lateral sections.

3. The carrier defined in claim 2 wherein said handle holes and said handle flaps are elongated in the direction parallel to said proximal edges, said handle flaps being attached to said handle holes along elongated sides thereof closest to said distal edges, said handle flaps having unattached free sides furtherest from said distal edges.

4. The carrier defined in claim 3 wherein said handle flaps have centrally-located slits therein, said slits extending normal to said elongated sides from the free elongated sides thereof about half the distance to the attached elongated sides.

5. The carrier defined in claim 1 wherein the length of said center section is substantially greater than said roll length.

6. The carrier defined in claim 1 wherein each of said lateral sections is generally the shape of a truncated isosceles triangle with said proximal edge thereof being the base of said triangle and said distal edge being the truncated vertex of said triangle.

7. The carrier defined in claim 1 wherein said center section has end portions which extend beyond said lateral sections, said carrier including means for binding each of the end portions of said center section which extend beyond said lateral sections.

8. The carrier defined in claim 7 wherein said binding means includes a loop-and-pile fastener pair at each end portion, one of said fastener pair being adhered to the surface of said end portion.

9. The carrier defined in claim 1 wherein said single piece is made of a material selected from the group consisting of heavy cardboard, corrugated paperboard, and synthetic plastic.

10. The carrier defined in claim 9 wherein said single piece is made of corrugated paperboard and the corrugations thereof extend parallel to said long sides.

11. A cut blank of stiff sheet material for producing a carrier for a roll of blueprints or the like, said roll having a roll length and a roll circumference, said blank comprising a substantially rectangular center section having substantially parallel long sides and a matching pair of lateral sections integral with and attached to said long sides, said center section having an outer major surface and an inner major surface, said inner major surface having a plurality of substantially parallel fold lines along and between said long sides, said fold lines adapting said center section to be bent to a semicircular shape substantially conforming to said roll circumference, said lateral sections having proximal edges and opposite distal edges, said proximal edges being shorter than and symmetrically attached to said long sides of said center section, said lateral sections having handle means closely spaced from said distal edges thereof.

12. The blank defined in claim 11 wherein said handle means includes an elongated handle hole and a handle flap centered in and closely spaced from the distal edge of each of said lateral sections.

13. The blank defined in claim 11 wherein each of said lateral sections is generally the shape of a truncated isosceles triangle and wherein said proximal edge is the base of said triangle and said distal edge is the truncated vertex of said triangle.

14. The blank defined in claim 11 wherein said handle means includes handle holes and handle flaps elongated in the direction parallel to said proximal edges, and said handle flaps are attached to the elongated sides of said handle holes closest to said distal edges, said handle flaps having unattached free sides furtherest from said distal edges.

15. The blank defined in claim 14 including a centrally-located slit in each of said handle flaps, said slit extending from the free elongated side of said flap about half the distance to said attached side of said flap.

16. The blank defined in claim 11 wherein said center section has end portions which extend beyond said lateral sections, said carrier including a means for binding each of the end portions of said center section which extend beyond said lateral sections when said center section is bent to said semicircular shape.

17. The blank defined in claim 16 wherein each of said binding means includes a loop-and-pile fastener pair, one of said pairs being adhered to the outer surface of said center section in each of said end portions.

18. The blank defined in claim 11 wherein said stiff material is selected from the group consisting of heavy cardboard, corrugated paperboard and synthetic plastic.

19. The blank defined in claim 18 wherein said stiff material is corrugated paperboard.

20. The blank defined in claim 19 wherein the corrugations of said corrugated paperboard are in a direction normal to said long sides of said center section.

* * * * *